United States Patent [19]

Witt

[11] 4,193,583

[45] Mar. 18, 1980

[54] CHAIN LINK FENCE EXTENSION

[76] Inventor: Russell L. Witt, P.O. Box 94044, Houston, Tex. 77018

[21] Appl. No.: 2,634

[22] Filed: Jan. 11, 1979

[51] Int. Cl.[2] ..... E04H 17/00

[52] U.S. Cl. ..... 256/11; 256/32; 256/47

[58] Field of Search ..... 256/11, 32, 34, 35, 256/36, 47, 1, 12.5, 33, 45

[56] References Cited

U.S. PATENT DOCUMENTS

| | | | |
|---|---|---|---|
| 353,903 | 12/1886 | Whittington | 256/1 |
| 457,044 | 8/1891 | Duffey et al. | 256/45 |
| 563,509 | 7/1896 | Sandoe | 256/11 |
| 571,491 | 11/1896 | Mason | 256/34 |
| 825,916 | 7/1906 | Mahaffy | 256/35 |
| 2,760,759 | 8/1956 | Rice | 256/34 |
| 2,785,877 | 3/1957 | Parks | 256/34 |
| 2,802,645 | 8/1957 | Rice | 256/34 |
| 3,771,767 | 11/1973 | Dougherty | 256/11 |
| 3,806,095 | 4/1974 | Ford | 256/34 X |

*Primary Examiner*—Andrew V. Kundrat
*Attorney, Agent, or Firm*—Dowell & Dowell

[57] ABSTRACT

An extension for a fence of the chain link type, the extension having an upper panel portion and having mounting leg portions extending downwardly therefrom and passing vertically through openings in the chain link fabric to secure the extension thereto, each leg portion having an abutment thereon to limit downward travel of a leg portion into the fabric and having detents especially shaped and located along the leg surfaces to cooperate with the wires of the fabric to resist upward withdrawal of the leg portion from the fabric, once installed.

6 Claims, 5 Drawing Figures

CHAIN LINK FENCE EXTENSION

FIELD OF INVENTION

This invention relates to extensions to be installed along the top of an existing chain link fence to increase its height, and more particularly relates to extensions which can be attached to a fence very easily as separately manufactured segments that a homeowner can purchase and mount side-by-side along the top of his fence, for example to confine a pet animal.

BACKGROUND AND PRIOR ART

The chain link type of fence is probably the best known and most practical fence used in the United States at the present time. However, it is difficult to alter such a fence to provide visual privacy, and it is rather difficult to extend the fence vertically upwardly when a somewhat higher structure is required, for instance to confine a pet dog.

The usual way of extending the height of a chain link fence is to stretch a wire extension on top of it, of the type shown for instance in U.S. Pat. No. 3,771,767 to Daugherty. However, this type of extension has a very institutional look which is not suitable for use in residential areas, for example. Various other types of ornamental extensions have been proposed, of which the one shown in U.S. Pat. No. 457,044 to Duffey et al is similar in some ways to the present disclosure since it can be mounted on top of an existing fence to extend the height somewhat in a decorative manner. Greater privacy is achieved in a chain link fence, for instance, by passing slats down through the openings in the wire mesh as shown in U.S. Pat. Nos. 2,760,759 and 2,802,645 to Rice, the disclosures showing an increase in the height of the fence in FIG. 4 of each of those patents. U.S. Pat. No. 2,785,877 to Parks shows a somewhat similar concept, using a bamboo screen which is simply attached to an existing chain link fence by wiring it to the fence.

THE INVENTION

The present invention comprises a number of separable segments each providing an extension of the height of the fence along a predetermined increment of length. Each extension segment includes a panel portion which after installation is located above the top of the existing chain link fence and provides any desired panel configuration, preferably or ornamental design which will enhance the appearance of the fence while extending its height. Beneath the panel portion is the mounting leg portion which comprises multiple downwardly extending legs, each leg having an abutment near its top where it joins the panel portion, the abutment overlying the top of the fence and locating the panel portion at the correct height thereabove, while preventing downward insertion of the leg portion into the openings in the fabric of the chain link beyond the desired level, whereby all of the individual panel segments will be supported by the chain link fence at the same height.

The leg portions have detent means on at least some of their surfaces, and these detent means are located at selected distances beneath the abutments, and are shaped to cooperate with the wire fabric in such a way that the detents resist upward withdrawal of the leg portions from the openings in the fabric once the leg portions have been fully inserted therein. The drawings show two types of detents which are satisfactory but which by no means exhaust the possibilities. In one embodiment the detents comprise zig-zag grooves recessed into the surfaces of the legs where the fabric wires cross those surfaces so that the wires drop into the grooves after the legs are pushed into the openings of the fabric, thereby resisting withdrawal of the legs from the fabric. The other illustrated type of detent comprises upwardly facing protrusions which are spaced so that when the leg portion is pushed all the way down into the openings of the chain link fabric, the wires can be lodged in the crotches between the protrusions and the leg surface, thereby strongly resisting upward withdrawal of the leg portions. The appearance of the panel portions is intended to be decorative, and may comprise panels which are difficult to see through, appropriate for use with a chain link fence where the fabric is covered in some manner to achieve a greater degree of privacy, for instance by canvas panels or upright slats attached thereto.

It is a principal object of the invention to provide an extension for a chain link fence which can be made in a modular manner in discrete segments or lengths, purchasable by a homeowner for mounting on his chain link fence, each segment being self supporting and integral, and including a panel portion extending above the fence and including leg portions extending downwardly into the fabric of the fence for support.

Another object of the invention is to provide improved mounting means for fence extensions wherein the extensions are supported on the fence by leg portions which have near their upper ends abutments for locating all of the extensions with respect to the top of the fence, and which prevent accidental downward displacement of a segment beyond the desired level. Each leg portion has detent means which are especially shaped and especially located below the abutments so as to receive and cooperate with the zig-zag wires of the chain link fence fabric so as to grip the wires and resist upward withdrawal of the leg portions from the fabric. The leg portions have front and rear surfaces and opposed side surfaces which are mutually spaced in such a manner that the leg portions are a very snug fit in the openings in the chain link fabric. They can be vertically inserted into the fabric openings and held snugly enough that the panel portion at the top of the fence is substantially rigidly supported, whereby accurate alignment of each panel portion segment with those on either side thereof is achieved.

Still another object of the invention is to terminate the ends of the panel portions in such a manner that when two panel portions are mounted side-by-side in the fabric, their adjacent ends will substantially meet so that the panel portions give the casual observer the impression that the panel portions comprise one continuous length of fence material rather than separable segments. Optionally, the ends of adjacent panel portions may be made to overlap so that they can be bolted, or otherwise secured, together.

Still another object of the invention is to provide extensions which are easily and economically manufactured from a variety of available materials. The extensions can be made of galvanized iron, aluminum, or molded plastic, etc., or they can even be fabricated of wood, although the latter would be the most expensive structure.

Other objects and advantages of the invention will become apparent during the following discussions of the drawings wherein:

THE DRAWINGS

Figure 1:
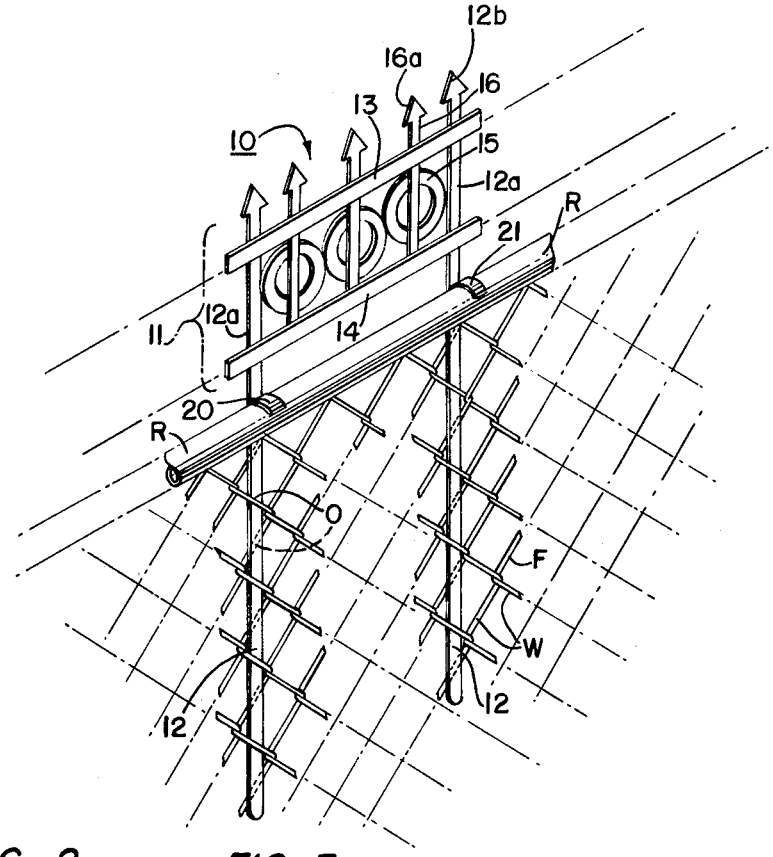
FIG. 1 is a partial perspective view showing an extension according to the present invention mounted on a chain link fence of standard construction.

Referring now to the drawings, and particularly to FIG. 1, this figure shows a short length of typical chain link fence including a chain link fabric F comprising interlinked wires W, the fence having a top edge which is terminated by a top rail R, all as well known in the prior art. Each of the wires W is vertically continuous, and zig-zags back and forth at 45° angles, leaving openings which as viewed from above are sufficient to receive a slat-like member which can be pushed down through the fabric. This type of insertion through the vertically aligned openings of a fence fabric is shown for example in the U.S. Pat. Nos. 2,760,759 and 2,802,645 mentioned above. Therefore, each vertical series of openings O is bounded by the zig-zag runs of adjacent wires W as shown in FIG. 1.

FIG. 1 illustrates one complete extension segment 10 made according to the present invention. It comprises a panel portion 11 and a leg portion including two legs 12 extending below the panel portion 11. The present panel portion 11 shows two longitudinal bars 13 and 14 attached to vertical extensions **12*a* of the leg portions 12 and these bars 13 and 14 support decorative members such as the members 15 and 16, which are provided with decorative head portions 16*a* which match the head portions 12*b*** of the legs. The particular design of the panel portion illustrated forms no part of the present invention, but is intended to be illustrative of a larger number of possible utilitarian or decorative designs.

The leg portions which extend downwardly from the panel portion 11 serve the purpose of mounting the panel portion to the fence without requiring any tools to achieve this purpose. The leg portions include near their upper ends a pair of abutments 20 and 21 which are integral with the leg portion 12 and which overlie the top rail R and locate the panel portion at a predetermined distance above the top of the fence, so that all of the adjacent panel portions will be in mutual alignment at a predetermined height.

Figure 2:
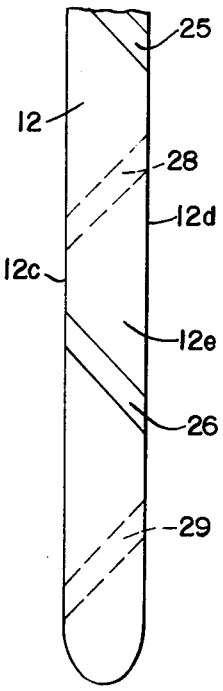
FIG. 2 is an enlarged front elevation view of a leg portion having detents in the form of diagonal grooves on opposite faces of the leg portion.
Figure 3:
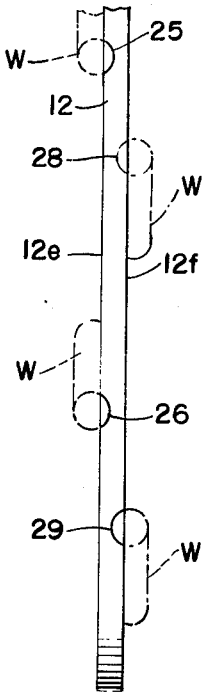
FIG. 3 is a side elevation view of the structure shown in FIG. 2.

FIG. 2 and FIG. 3 show a leg portion 12 comprising a slat having front and rear faces, of which the front face is visible in FIG. 2, and having side faces one of which is visible in FIG. 3. The side faces are labeled **12*c* and 12*d*, the front face is labeled 12*e*, and the rear face is labeled 12*f*. The front face 12*e* has a series of diagonally oriented grooves 25, 26, . . . There are as many diagonal grooves extending downwardly to the right as there are wires extending downwardly to the right on the fence which intersects the leg, for instance four in the present illustration, although only two are shown in FIGS. 2 or 3. Likewise, the rear surface 12*f* can be provided with grooves 28, 29, . . . which extend downwardly to the left in FIG. 2, and the total number of these grooves is the same as the number of wires which extend downwardly to the left and intersect the leg, namely five as shown in the illustrative embodiment of FIG. 1. The wires W are shown in phantom lines in the grooves in FIG. 3. These grooves serve as detents for resisting withdrawal of the leg portions 12 from the openings in the wire fabric once the leg portions are in place and the wires W are located in the grooves on each side of the leg portion. If desired, the bottom diagonal groove 29 could be left off of each leg, and this would provide a slight bending of the leg so as to make the grooves 26 and 28** above it latch tighter around the fabric wires. Another possibility would be to entirely omit the grooves on the front or rear surface of leg.

Figure 4:
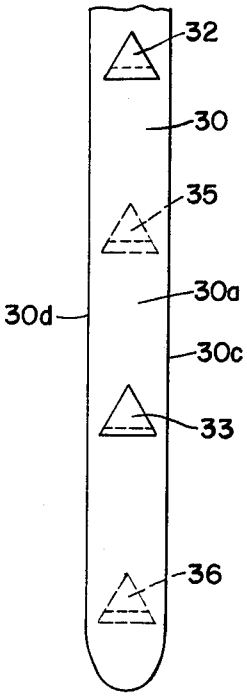
FIG. 4 is a front elevational view of a modified form of the leg portion showing detent means in the form of protruding upwardly extending lugs.
Figure 5:
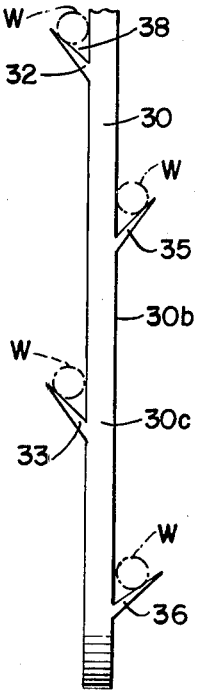
FIG. 5 is a side elevation view of the leg portion shown in FIG. 4.

FIGS. 4 and 5 show a modified embodiment of the leg portions, which will be labeled 30. The leg portions 30 are the same shape as the leg portions 12 as far as their cross-section is concerned, but instead of having grooves in the surface to receive the wires, they have outwardly extending protrusions in the form of lugs which on the front surface **30*a* are labeled 32 and 33, . . . , and on the back surface 30*b* are labeled 35 and 36, . . . . These lugs can be molded with the surface of a plastic leg 30, or alternatively they can be bumped out of a sheet metal leg in a manner well known per se. For instance, the legs 30 can be made of sheet metal by making the two larger panels comprising the front surface 30*a* and the rear surface 30*d* attached together by only one side surface such as the surface 30*c*, these surfaces then being bent at right angles leaving the other side 30*d* open. Various other manufacturing techniques are believed to be within the skill of the prior art in forming these lugs on the leg portions 30. At any rate, each lug forms with the adjacent surface of the leg 30 a crotch, such as the crotch 38 shown at the top of FIG. 5, and each of these crotches is occupied by a wire W of the chain link fabric, the wires being shown in phantom lines. Once the extension having legs 30 is mounted in place it can be forced downwardly slightly, or the fabric can be raised slightly with respect to the top rail of the fence so that the lugs 32, 33, 35, 36, . . . , pass temporarily beneath the wires W and admit them to the crotch 38**.

This invention is not to be limited to the exact forms shown in the drawings, for obviously changes can be made within the scope of the following claims.

I claim:

1. An extension to be applied to the top of a chain link type of fence for raising its height, the fence including a fabric of wires interlinked in zig-zag configuration and defining multiple adjacent vertical openings extending through the links between the wires, the extension comprising:

a panel portion to be located in a vertical plane above the chain link fabric to extend the height of the fence thereabove;

a mounting leg portion extending downwardly from the panel portion parallel to said vertical plane and comprising vertically elongated leg means having opposed front and rear surfaces and opposed side surfaces mutually spaced to slide into and snugly fit within vertical openings of the fabric and be supported thereby;

abutment means fixed to and extending transversely from the leg means adjacent to the panel portion and disposed to overlie the top of the fence and prevent further downward sliding of the leg means in the openings of the fabric; and some of said leg surfaces having detent means shaped to slide downwardly past the zig-zag fabric wires defining the openings when the leg means are inserted therein, but said detent means being operative to resist upward withdrawal of the leg means from the fabric.

2. An extension as claimed in claim 1, wherein the panel portion comprises a unitary structure having a predetermined length and its mounting leg portion comprises at least two separate leg means mutually spaced apart horizontally by an integral multiple of the horizontal distance between adjacent vertical openings in the fabric, the opposed front and rear surfaces of the leg means having diagonal grooves comprising said detent means and disposed across the surfaces to provide an inclined pattern matching the zig-zag configuration of the fabric wires defining the openings through which the leg means extend.

3. An extension as claimed in claim 2, wherein the vertical separations between the abutment means and the grooves, and between adjacent grooves on each leg means, are such that when the abutment means rests on top of the fence, the fabric wires lie in the grooves in the leg means.

4. An extension as claimed in claim 1, wherein the fence has a top rail running along the upper edge of the fabric and comprising the top of the fence, and each abutment means comprises an arcuate clip fixed on a leg means and shaped to overlie and conform to the surface of the top rail.

5. An extension as claimed in claimed in claim 1, wherein the panel portion comprises a unitary structure having a predetermined length and its mounting leg portion comprises at least two separate leg means mutually spaced apart horizontally by an integral multiple of the horizontal distance between adjacent vertical openings in the fabric, the opposed front and rear surfaces of the leg means having protrusions comprising said detent means and respectively located to underlie the zig-zag fabric wires defining the openings through which the leg means extend.

6. An extension as claimed in claim 5, wherein the protrusions each comprises a lug extending from a surface of the leg means and opening diagonally upwardly to provide a crotch between the lug and the adjacent surface of the leg means for receiving a wire.

* * * * *